US008776366B2

(12) United States Patent
Mita et al.

(10) Patent No.: US 8,776,366 B2
(45) Date of Patent: Jul. 15, 2014

(54) CONDUCTOR WIRE CONNECTING METHOD

(75) Inventors: Toru Mita, Kosyu (JP); Yuji Saito, Hitachinaka (JP)

(73) Assignee: Hitachi, Ltd., Tokyo (JP)

( * ) Notice: Subject to any disclaimer, the term of this patent is extended or adjusted under 35 U.S.C. 154(b) by 153 days.

(21) Appl. No.: 13/345,985

(22) Filed: Jan. 9, 2012

(65) Prior Publication Data

US 2012/0159783 A1 Jun. 28, 2012

Related U.S. Application Data

(62) Division of application No. 12/471,876, filed on May 26, 2009, now Pat. No. 8,153,899.

(30) Foreign Application Priority Data

Jun. 18, 2008 (JP) ..... 2008-158957

(51) Int. Cl.
*H01R 43/02* (2006.01)
*H01R 43/05* (2006.01)
*H01R 4/20* (2006.01)

(52) U.S. Cl.
CPC . *H01R 43/05* (2013.01); *H01R 4/20* (2013.01)
USPC ..... 29/860; 29/753; 29/863; 29/872

(58) Field of Classification Search
CPC ..... H01R 43/0228; H01R 43/04–43/058
USPC ..... 29/753, 860, 863, 872
See application file for complete search history.

(56) References Cited

U.S. PATENT DOCUMENTS

| | | | | |
|---|---|---|---|---|
| 4,794,688 | A | 1/1989 | Wada et al. | |
| 5,660,742 | A * | 8/1997 | Warner et al. | 219/85.16 |
| 6,816,052 | B1 | 11/2004 | Ziegler | |
| 7,207,204 | B2 | 4/2007 | Weber et al. | |
| 7,282,679 | B2 | 10/2007 | Reichinger | |
| 2001/0002508 | A1 * | 6/2001 | Yamakawa | 29/753 |

FOREIGN PATENT DOCUMENTS

| | | | |
|---|---|---|---|
| JP | 5-38583 | A | 2/1993 |
| JP | 11-40310 | A | 2/1999 |

* cited by examiner

*Primary Examiner* — Livius R Cazan
(74) *Attorney, Agent, or Firm* — Crowell & Moring LLP

(57) ABSTRACT

After melted enamel coating is discharged, a fusion process of electrical wire-to-wire connection is carried out inside a crimping connector. In the conductor connection method based on the fusion process, a plurality of enamel-coated conductor wires are inserted in the crimping connector prior to the start of the fusion process. Further, a temporary crimping process that provides the crimping connector a temporary crimping by mechanical pressurizing means is also performed. Addition of force at both end parts or either end part of the cross-section orthogonal to the axis of the above crimping connector may cause expansion, which needs to be suppressed with external force. At the same time, the cross-sectional areas corresponding to both end parts or either end part should preferably be as small as possible. The temporary crimping is applied to the crimping connector for this purpose.

4 Claims, 6 Drawing Sheets

CONDUCTOR WIRE CONNECTING METHOD

CROSS-REFERENCE TO RELATED APPLICATIONS

This application is a divisional of U.S. application Ser. No. 12/471,876, filed May 26, 2009, now U.S. Pat. No. 8,153,899, and claims priority of Japanese patent application no. 2008-158957, filed Jun. 18, 2008, the entire contents of which are hereby incorporated by reference.

FIELD OF THE INVENTION

This invention relates to a connecting method of electrical conductor wire; and connecting terminals, stators, and rotary electric machines.

BACKGROUND OF THE INVENTION

Japanese Unexamined Patent Application Publication No. HEI11(1999)-40310 discloses the technique by which plural electric wires is electrically and physically connected to the terminals by inserting the electric wire ends in the terminals and fusing them all at the same time. Such an electrified caulking device as used for an electrical conductor wire connecting device of a fusing type comprises a pair of electrodes for heating and pressurization which are made movable so as to be able to vary the distance between the two electrodes, a driving means to move at least one of the two, and a power source capable of feeding electricity to both the electrodes. When the above electrical conductor wire connecting device is used for its intended purpose, a cylinder-shaped terminal inserted with plural conductor wires each with insulating coating and held between both the electrodes is turned on electricity. The terminal, while kept in that state, is then pressurized by bringing both the electrodes closer to each other. Japanese Unexamined Patent Application Publication No. HEI11(1999)-40310 also describes that in the process of fusing the plural electric conductor wires in a lump, any excessive crush of the terminal (which may also be called as a "crimping connector" or "sleeve tube") owing to temperature rise, hence the variability of crush of each electrical conductor wire, can be controlled by adjusting the positions of the two electrodes opposed to each other by a mechanical means as well as by reducing the current for electrification; with the result that it becomes possible to evenly pressurize each electrical conductor wire.

Further, Japanese Unexamined Patent Application Publication No. HEI11(1999)-40310 includes such descriptions that, when the crimping connector or sleeve tube is pinched for crushing with the electrodes each having a flat pressurizing surface in the conventional process of fusing the plural electric conductor wire ends in a lump, degree of crushing is less in the center part and both the end parts of the crimping connector, making it difficult to obtain even state of connection and causing different conditions of crushing to each and every electric conductor wire; and that in consideration of the foregoing events, proper adjustment should be made of the positions of the electrodes to be electrified, heated and pressurized and the strength of electrifying current so that force may be uniformly applied to each and every electric conductor wires in the crimping connector or sleeve tube.

Japanese Unexamined Patent Application Publication No. HEI5(1993)-38583 discloses a method for connecting plural coated conductor wires to connecting terminals, wherein plural coated conductor wire ends are twisted together and stored on plural hooks formed on the connecting terminals made of copper or copper alloy plate; the twisted wire ends are supported by plural hooks pressurized and deformed with electrode rods; and the electrode rods are electrified to remove coating from the coated conductor wires so as to electrically connect the wires to the hooks of the connecting terminals.

In the process of fusing many ends of wire all in a lump and when the electrode having a flat pressurizing surface is used to crush the crimping connector or sleeve tube, degree of crushing is less at both the end parts of the crimping connector than in the center part where the connector is pinched with the electrode. Therefore, in around the wire ends where the degree of crushing is little or less, it sometimes happens that the melted enamel coating cannot be squeezed out sufficiently, leaving the electrical connection in an incomplete state.

In the past, in the process of crushing the connector part of the electric conductor wire by means of a flat-surfaced electrode, the wire located at both the ends of the crushed connector part used to remain in an almost uncrushed state. To the contrary, the electric conductor wire located in the center part used to be crushed to a more-than-necessary degree, leading to the problem that a necessary cross-sectional area was hard to obtain. Furthermore, there is difference in the manner of being crushed between in the upper and lower parts of the connector part and in the center part of the connector; the crushing degree is high in the former and low in the latter.

As mentioned above, the crushing degree of the electrical conductor wire ends to be crushed within the connector part is different depending on where the wire ends are located in the connector part during the fusing process, but none of the crushing conditions was enough to crush all the connecting wire ends in a stable state. As a result, the enamel coating could not be squeezed out sufficiently from around the electrical conductor wire for which crushing was done only insufficiently, failing to complete electrical connection. On the contrary, the crushing degree is higher in the center part than in both the end parts, causing such problem that the electrical conductor wire became short in mechanical tensile strength.

SUMMARY OF THE INVENTION

An object of the present invention is to provide the method of connecting plural electrical conductor wire of various electric appliances by the fusing system utilizing pressurization and electrification, and also to provide the method of ensuring electrical connection of the electrical conductor wire at the connecting terminals and enhancing mechanical tensile strength of the electrical conductor wire at the connecting terminals.

The present invention is basically configured as follows.

The first aspect relates to the electrical conductor wire connecting method. That is, plural enamel-coated conductor wire ends is inserted in a tube-shaped crimping connector, a connection part, which is then pinched with electrodes for pressurization and electrification, thereby causing the above crimping terminals along with the enamel-coated conductor wire to be heated and crimped and further to be pressurized and deformed simultaneously to discharge melted enamel coating out of the above crimping connector, allowing the conductor wire ends to be electrically jointed one another by fusing within the crimping connector. In such conductor wire connecting method described hereinabove, a temporary crimping as explained below is conducted prior to the above fusing process. After plural the above enamel-coated conductor wire is inserted into the above crimping connector, a temporary crimping is added to the crimping connector. This temporary crimping is characterized in that the temporary crimping on the above crimping connector is carried out in the manner to use external force and suppress expansion likely to be caused by pressure given to both the ends or one end of the cross-section positioned orthogonally to the axis of the above crimping connector so that the cross-sectional area of both the ends or one end may become small.

The second aspect relates to the connector terminal. That is, the connector terminal comprises plural enamel-coated conductor wire and the crimping connector or the connector part that is used to electrically connect the enamel-coated conductor wire to the mating conductor wire. The connector terminal is further characterized in that the above enamel-coated conductor wire together with the mating conductor wire are inserted into the above crimping connector and fused for complete electrical connection and that, in the connector terminal in the aforesaid state, the above crimping connector is in a shape of flattened tube formed so by pressure forming, while both the ends or one end of the cross-section positioned orthogonally to the axis of the above crimping connector are or is made either to become thinner toward outside taking the form of an acute angle or otherwise to be dented inward.

According to the present invention, the fusing system adopted for conductor wire connection makes it possible to increase the crimping degree of the conductor wire located in the end part of the above cross-section of the crimping connector in the shape of flattened tube formed so by pressure forming and to ensure electrical connection, while enhancement can be attained at the same time in the mechanical tensile strength of the conductor wire at the connector terminal.

DETAILED DESCRIPTION OF THE PREFERRED EMBODIMENTS

The conductor wire jointing method of the fusing system according to the present invention is divided roughly into the temporary crimping process conducted by the mechanical pressing means and the fusing process to be subsequently executed by means of a heating and pressing arrangement of electrode.

The temporary crimping process is made to proceed as follows.

Figure 2:
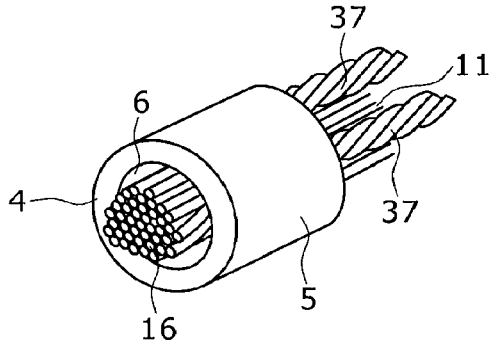
FIG. 2 is a perspective view showing the state in which a bundle of conductor wires including twisted wire is inserted in a crimping connector, as an embodiment of the present invention.
Figure 3:
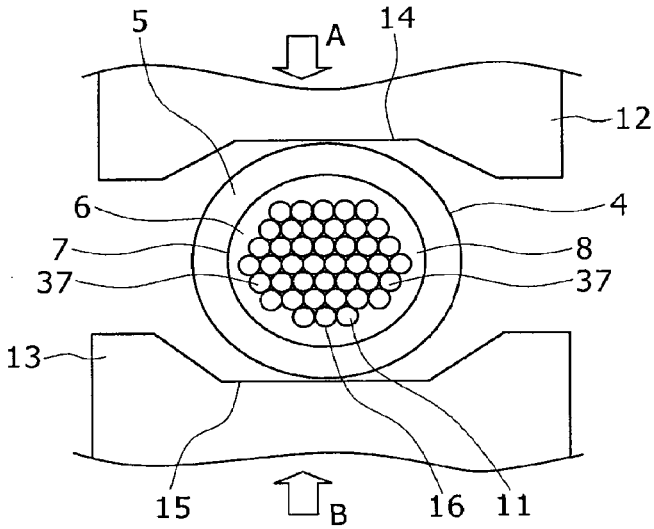
FIG. 3 is a schematic cross-sectional view showing the temporary crimping process as an embodiment of the present invention.
Figure 5:
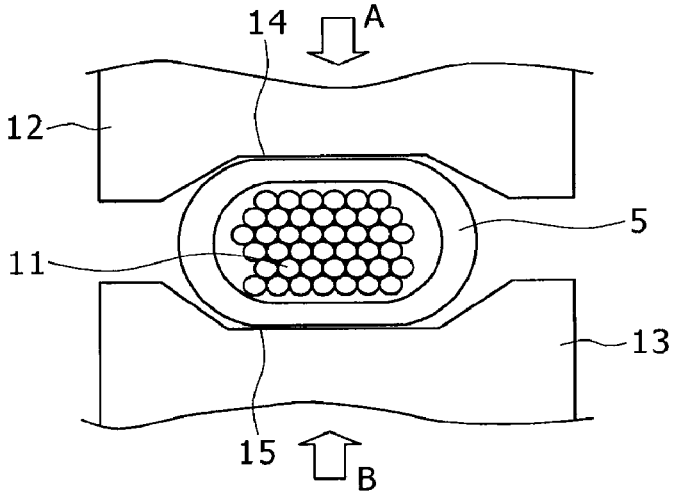
FIG. 5 is a schematic cross-sectional view showing the state of the temporary crimping process in progress, as an embodiment of the present invention.
Figure 6:
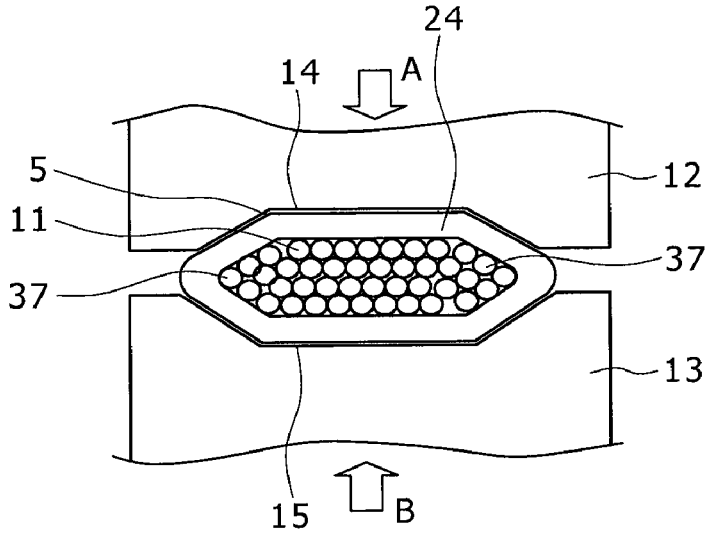
FIG. 6 is a schematic cross-sectional view showing the state of the temporary crimping process after completed, as an embodiment of the present invention.
Figure 10:
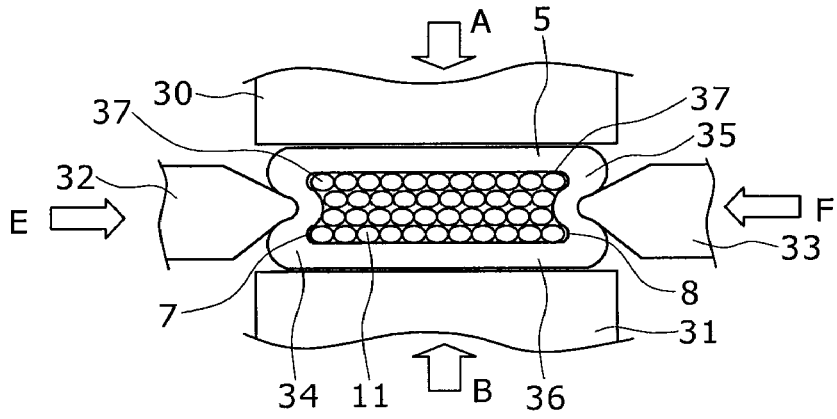
FIG. 10 is a schematic cross-sectional view showing the state of the temporary crimping process, as another embodiment of the present invention.

As shown in FIG. 2, plural enamel-coated conductor wire 37 (the wire designated as 37 is actually a wire twisted from the enamel-coated wire 1; for convenience sake, this twisted wire 37 is called here as the "enamel-coated conductor wire") is inserted into the tube-shaped crimping connector 4 prior to pressing and electrifying in the fusing process. Then, as shown in FIGS. 3, 5 and 6, the force to cause temporary crimping is applied to the crimping connector 4 by means of the mechanical pressing means 12 and 13 with caution being paid to suppressing expansion, which otherwise might occur in both the end parts 7 and 8 (or one end part of them) of the cross-section orthogonal to the axis of the crimping connector 4, with employing the above external force so that the area of both the end parts 7 and 8 in the cross-section may become smaller. In order to carry out such temporary crimping successfully, it is desirable that both the end parts 7 and 8 of the crimping connector should be made either to become slimmer toward outside taking the form of an acute angle as shown for example in FIG. 6, or otherwise to be dented inward as shown in FIG. 10 while the remaining parts should be kept flat.

Additionally, the plural enamel-coated wire 37 should preferably be turned into twisted one before being placed in both the above end parts 7 and 8 in the cross-section.

Through this temporary crimping process, it is possible to enhance the pressing deformation force (temporary crimping force) to be applied to both the end parts 7 and 8 of the cross-section orthogonal to the axis of the crimping connector 4 (both the end parts are also orthogonal to the direction of pressing force). As a result, the temporary crimping force to be added from both the end parts 7 and 8 of the crimping connector to the inside proves useful for strengthen the degree of crimping between the enamel-coated conductor wire 37 and the internal surface of the crimping connector 4, between each other of the enamel-coated conductor wires, and the enamel-coated conductor wire 37 and the conductor wire 11 as the mating target of connection; thus, it becomes possible to bring almost all of these gaps to naught, thereby enabling each mating object for connection to stay coherent.

Figure 7:
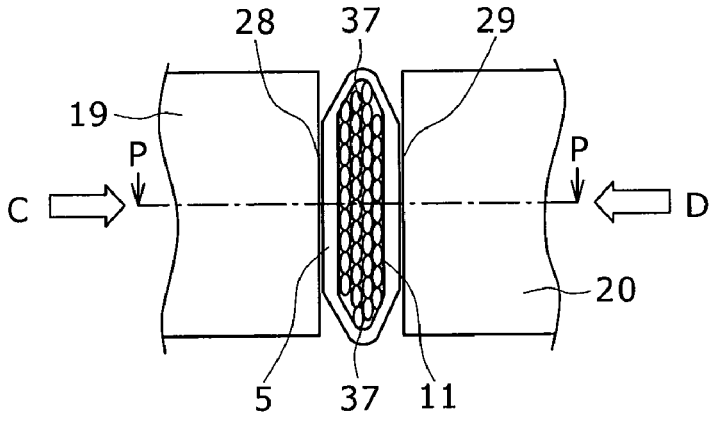
FIG. 7 is a schematic vertical cross-sectional view showing the state of the fusing process after completion of the temporary crimping process, as an embodiment of the present invention.

In the next place, the fusing process is made to proceed as follows. As shown in FIG. 7, the crimping connector 4 after the temporary crimping has been carried out is pinched, pressed, and electrified by the electrodes to realize heating and crimping of the enamel-coated conductor wire 37. In this process, the crimping connector 4 and the enamel-coated conductor wire 37 are pressed for deformation at the same time to allow the melted enamel coating to be discharged out of the crimping connector 4. The conductor wires from which enamel coating has been removed are electrically jointed with one another in the above manner inside the crimping connector.

According to the present invention, fusing can be conducted by using flat electrodes, and therefore, there is no need to change the fusing electrodes only for the sake of conforming to every different shape of connecting terminals.

The present invention also ensures that the conductor wires located in both the end parts of the connecting component after completion of fusing are sufficiently deformed, rid of melted enamel coating, and provided with a satisfactory state of electrical connection.

Further, explanation is made of the above embodiments for realizing the best mode in reference to the drawings as below.

First Embodiment

Figure 1:
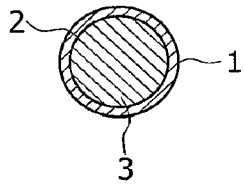
FIG. 1 is a cross-sectional view of enamel-coated conductor wire used as an embodiment of the present invention.
Figure 4:
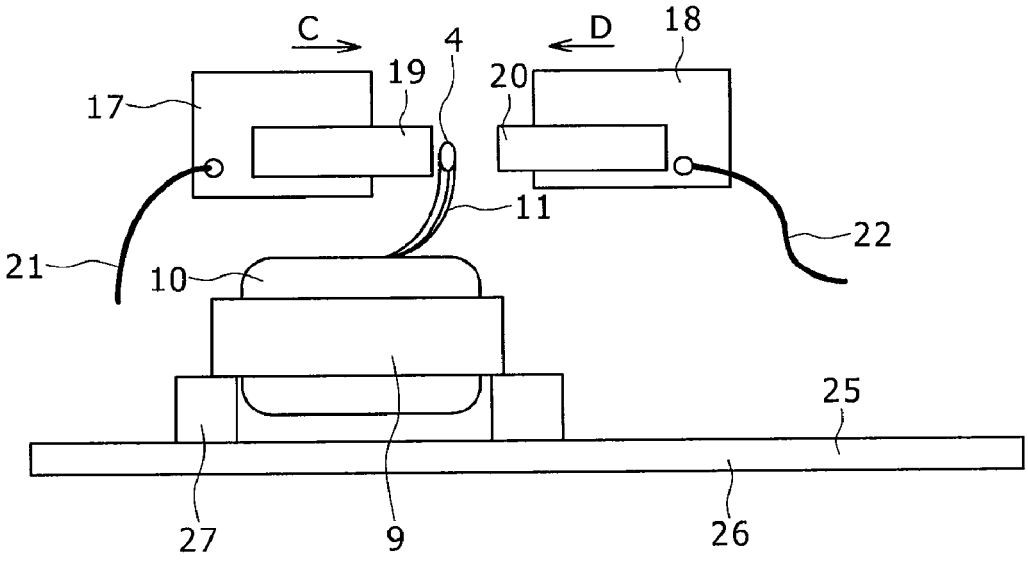
FIG. 4 is a schematic side view of the fusing process as an embodiment of the present invention.
Figure 8:
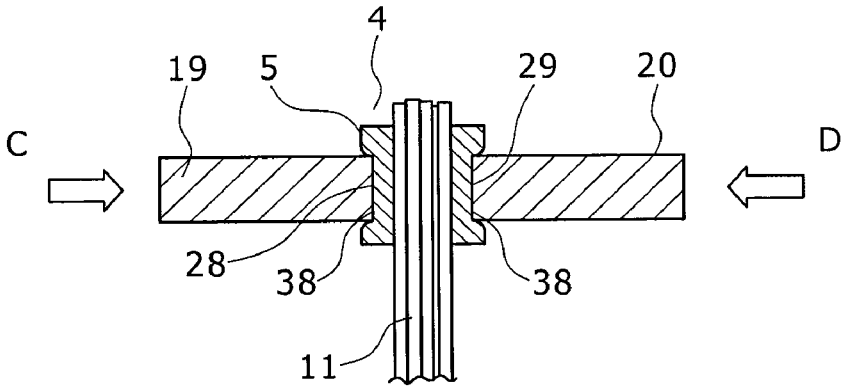
FIG. 8 is a schematic horizontal cross-sectional view showing the state of the fusing process after completion of the temporary crimping process, as an embodiment of the present invention.

FIG. 1 is a cross-sectional view of the enamel-coated conductor wire as used in the present embodiment. FIG. 2 is a perspective view showing the state in which a bundle of conductor wires including twisted wire is inserted in a crimping connector, as used for the present embodiment. FIG. 3 is a schematic cross-sectional view showing the temporary crimping process as used in the present embodiment. FIG. 4 is a schematic side view of the fusing process (a heating and pressing device) as used in the present embodiment. FIG. 5 is a schematic cross-sectional view showing the state of the temporary crimping process in progress, as used in the present embodiment. FIG. 6 is a schematic cross-sectional view showing the state of the temporary crimping process after completed, as used in the present embodiment. FIG. 7 is a schematic vertical cross-sectional view showing the state of the fusing process following the completion of the temporary crimping process, as used in the present embodiment. FIG. 8 is a cross-sectional view along the line P-P in FIG. 7.

In FIG. 1, denoted as 1 is the enamel-coated conductor wire, which is the object for connection by means of fusing in the present invention. Denoted as 2 is the enamel coating itself applied to the enamel-coated conductor wire 1. Denoted as 3 is the core wire used for the enamel-coated conductor wire 1. Copper or copper alloy is preferred as the material of the enamel-coated conductor wire. In the present embodiment, winding of a stator of a rotary electric machine is shown to illustrate an example of use of the enamel-coated conductor wire 1.

In FIG. 2, denoted as 4 is the crimping connector (it may be called also as a connecting component) taking the form of conductive metallic tube. Denoted 37 is a twisted wire into which plural enamel-coated conductor wire 1 is bundled and twisted. Denoted 5 is the conductor wire connecting part of the crimping connector 4. The inside of the crimping connector (in a tube form) 4 is used as a bore 6 into which the conductor wires are loaded.

Denoted as 11 is another set of electric wires which serves as the mating target for electrical connection with the twisted wire 37 (the enamel-coated conductor wire 1). Plural electric wires 11 are bundled and inserted into the crimping connector 4 together with the twisted wire 37. This electric wire 11 assumes lead wires generally used in various types of electric equipment. One example is a lead wire for the neutral point of a polyphase rotary electric machine, but it should not be considered as limiting the scope of the present invention.

Figure 14:
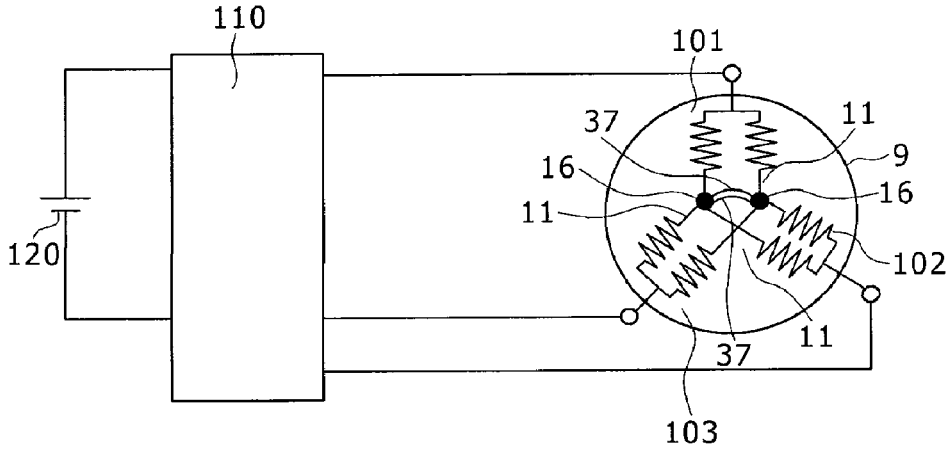
FIG. 14 is a schematic circuit diagram showing the wiring of the rotary electric machine according to the present invention.

With reference to FIG. 14, explanation is given here of the case of three-phase rotary electric machine as a typical example of the polyphase rotary electric machine.

FIG. 14 is a schematic circuit diagram showing wiring of a rotary electric machine that can become an object to which the present embodiment is applicable.

The stator of the rotary electric machine according to the present embodiment has coils for 3-phase, namely, the phase-U coil 101, the phase-V coil 102, and the phase-W coil 103. The neutral point 16 for these coils is composed of one end of the lead wire 11 of each phase coil, and comprises a total of three ends (3 points) from three pieces (3-phase) of lead wire 11. The lead wire 11 for the neutral point of each phase is to be connected mutually with the above twisted wire 37 via the temporary crimping process and the fusing process, both of which have been described in the foregoing.

The power source 120 of this rotary electric machine is DC (direct current) to be converted to AC (alternate current) by the 3-phase inverter 110. The present embodiment uses a DC power source. However, this invention is not limited to a DC power source but it permits the use of an AC power source as well.

Figure 9:
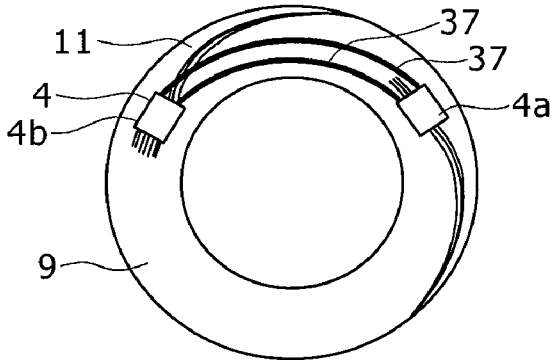
FIG. 9 is a top view showing the arrangement of a bundle of the conductor wires including twisted wire and the crimping connector in the conductor wire connecting part of the stator, as an embodiment of the present invention.

FIG. 9 shows a concrete mode in which the above lead wires 11 for the neutral points and the twisted wires 37 for connection among neutral points are connected with one another via the crimping connector 4, when viewed from the side of winding of the stator 9.

As shown in FIG. 9, there are three pieces (3-phase) of crimping connector 4. Among them, the one situated in the center is denoted as 4*a*, and if the crimping connector 4*a* in the center is connected by the twisted wire 37 to the other crimping connectors 4*b* and 4*c* located respectively on the sides of 4*c*, it is possible to obtain a neutral point connection mode equivalent to what is shown in FIG. 14. Additionally, the two sets of twisted wires 37 connecting between the crimping connectors 4*a* and 4*b* and these twisted wires 37 are connected with the lead wires 11 at the crimping connector 4. More details about the connection with the lead wires are as follows.

With respect to FIG. 3, the notations 7 and 8 stand for both the end parts in the radius direction in the conductor wire loading bore 6 inside the conductor wire connecting part 5 and also stand for both the end parts in the radius direction orthogonal to the pressing direction of the temporary crimping molds 12 and 13 about which more details are appearing afterwards. The notations 7 and 8 are both the end parts orthogonal to the axis of the crimping connector 4 as well. The group of the lead wires 11 is disposed in a bundle in the central region of the conductor wire loading bore 6, and the two sets of twisted wires 37 are disposed in both the end parts 7 and 8, retaining the group of the lead wire 11 in between, in the conductor wire loading bore 6.

Notations 12 and 13 are a pair of temporary crimping molds for temporary crimping of the conductor wire connecting part 5 of the crimping connector 4. The pair of temporary crimping molds 12 and 13, each facing the other, is respectively provided with a groove having a section of trapezoidal shape, 14 and 15, situated just in the corresponding place where contact is made with the conductor wire connecting part 5. When the trapezoid-shaped grooves 14 and 15 pressurize the crimping connector 4 for deformation, both the end parts 7 and 8 of the conductor wire connecting part 5 in the crimping connector 4 are made to become slimmer toward outside taking the form of an acute angle. The temporary crimping molds 12 and 13 are attached to and a running part (not shown in the drawing) a press mechanism (not shown in the drawing) and driven in the directions as indicated by arrows A and B. On exercising temporary crimping, the conductor wire connecting part 5 of the crimping connector 4 needs to be set so that the conductor connecting part 5 may be properly held between the temporary crimping molds 12 and 13.

In FIG. 4, notation 25 is the fusing device, and notation 26 is the base board of the fusing device 25. Notation 27 is the positioning base mounted with the stator 9 of the polyphase rotary electric machine. Notations 17 and 18 are respectively the running parts of the constant-load press mechanism (not shown in the drawing) and are driven in the directions as indicated by arrows C and D. The running parts 17 and 18 are respectively attached with a pair of electrode bars 19 and 20 which are so designed as to be able to have a nip at the conductor wire connecting part 5 formed by the temporary crimping molds 12 and 13 with a predetermined load. The electrode bars 19 and 20 are connected with the conductor wires 21 and 22 to get supply of predetermined current. Via a control unit (not shown in the drawing), a power source unit (not shown in the drawing) is operated to supply current through the conductor wires 21 and 22 to the electrode bars 19 and 20.

When the constant-load press mechanism (not shown in the drawing) is operated, the electrode bars 19 and 20 pressurize and electrify the conductor wire connecting part 5 of the crimping connector 4, thereby heating and crimping the conductor wire connecting part 5.

When to conduct temporary crimping under the above configuration, it is necessary to insert in advance the lead wire 11 in the conductor wire loading bore 6 of the conductor wire connecting part 5 of the crimping connector 4, connecting it to the neutral point of the stator 9 (stator winding) of the rotary electric machine, and at the same time to insert on both the sides of the above lead wire 11 two sets of twisted wires 37 for connection to the neutral point. The twisted wires 37 should be inserted to where both the end parts 7 and 8 are to be located when the conductor wire loading bore 6 is crushed (when pressurized and deformed into a flat shape).

Then, while holding the conductor wire connecting part 5 of the crimping connector 4 between a pair of temporary crimping molds 12 and 13, the temporary crimping press mechanism (not shown in the drawing) is operated to drive the temporary crimping molds 12 and 13 into up and down reciprocal motion (along the direction as indicated by arrows A and B). With this up and down motion, the mold 12 is made to move to a predetermined position in relation to the mold 13, crushing the conductor connecting part 5 of the crimping connector 4. In this manner, crushing of the conductor wire connecting part 5 is carried out as shown in FIG. 5 and FIG. 6 until a predetermined shape of temporary crimping is formed. In other words, the press mechanism is operated so that the temporary crimping molds 12 and 13 attached to the running part 17 and 18 may pinch the conductor wire connecting part 5 from the directions of arrow A and arrow B. By means of the trapezoid-shaped grooves 14 and 15 designed in the temporary crimping molds 12 and 13, it is possible to achieve formation of predetermined temporary crimping shape 24 in such a way that both the end parts 7 and 8 of the conductor wire connecting bore 6 of the conductor wire connecting part 5 (the crimping connector 4) may become slimmer toward outside taking the form of an acute angle. This shape 24 means that the crimping connector 4 is flattened, taking a cross-section of hexagonal geometry. In this state, the temporary crimping process has completed at one point of the crimping connector 4 which is the neutral point 16 of the lead wire 11. At other neutral points 16, the temporary crimping process is completed when formation of the temporary crimping shape 24 is likewise finished.

In the next place, explanation is given about the fusing process with reference to FIG. 4 and FIG. 7.

The stator 9 is moved and set at the predetermined positioning base 27 on the base board 26 of the fusing device 25. In the next fusing process, the constant-pressure press mechanism (not shown in the drawing) is operated to move the running part 17 and 18 respectively in the direction indicated by the arrow C and D. The conductor wire connecting part 5 after temporary crimping is approached in the directions indicated by arrows C and D and pinched by the flat tips 28 and 29 of the electrode bars 19 and 20. The control device (not shown in the drawing) is operated until a predetermined slenderness is attained, and a predetermined current is supplied from the power source device (not shown in the drawing) to the electrode bars 19 and 20 via the conductor wire 21 and 22. Through these procedures, the conductor wire connecting part 5 is electrified and heated, and then crushed by pushing of the electrode bars 19 and 20 by the function of the constant-pressure press mechanism (not shown in the drawing). By repeating the foregoing procedures, a predetermined number of the conductor wire 5 of the crimping connector 4 are to be crushed through electrification and heating; at the same time, electrical connection among the lead wire 11, the twisted wire 37, and the crimping connector 4 is to be fulfilled. In consequence, the neutral point 16 of all the lead wires 11 arranged for the stator 9 of the rotary electric machine can be connected to the twisted wire 37 via the crimping connector 4.

In regard to the conductor wires inserted in the crimping connector 4 (the lead wire 11 and the twisted wire 37), it is thus possible to get rid of airspace and keep coherence within the fold of conductor wires, between the conductor wires and the inner circumference of the crimping connectors 4 (connection components). Particularly, the crimping connector 4 (connection components) which had potential to cause airspace in the past can now keep coherence among conductor wires and prevent occurrence of airspace by suppressing expansion sideways in both the end parts 7 and 8 in the cross-section orthogonal to the conductor wires and by adopting temporary crimping which has effect of reducing cross-sectional area. The above measures have also made it possible to enhance quality of connection of conductor wires by means of the crimping connector 4 and to avert fall of conductor wires.

The terminal connected electrically by way of fusing is called a "joining terminal."

According to the present invention, the state of connection of twisted wires at the neutral point makes it possible to obtain electrically stable resistance value and also to realize enhanced tensile strength.

Also, according to the present invention, only just enough amount of conductor wire needs to be crushed to obtain a prescribed state of connection.

As shown in FIG. 8, trace of electrode 38 will be left on the conductor wire connecting part 5 to which fusing is applied utilizing the electrode bars 19 and 20.

Next, with reference to FIG. 10, explanation is made of other embodiments relating to the temporary crimping process according to the present invention.

In the present embodiment, the crimping connecting part 5 of the crimping connector 4 is pinched by the temporary crimping jigs 30 and 31 in the directions indicated by arrows A and B each opposing to the other, and further, the crimping connecting part 5 is nipped in by the side-pushing jigs 32 and 33 in the directions indicated by arrows E and F each opposing to the other while both of them being orthogonal to the moving direction of A and B; all these pinching motions of A and B combined with the nipping-in motions of E and F work to crush the crimping connecting part 5. This forms concave parts 34 and 35 inside both end parts 7 and 8 of the crimping connector 4 to a temporary crimping shape 36. This is a concave shape formed toward the center of the cross-section at both end parts 7 and 8 of the cross-section orthogonal to enamel-coated conductor wires of the crimping connector 4 (connection components). The concave shape has been formed in both end parts; however, it is not limited to them and may be formed in at least one of the both end parts.

Figure 11:
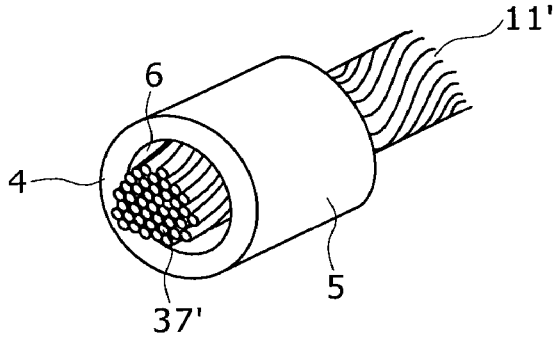
FIG. 11 is a perspective view showing the state of the twisted wire inserted in the crimping connector, as another embodiment of the present invention.

FIG. 11 is a perspective view showing the state of the twisted wire inserted in the crimping connector 4, as another embodiment of the present invention. In this embodiment, all the conductor wires 11' that are made the objects for connection are twisted together into a single twisted wire 37' which, in such a singled form, is inserted in the conductor wire loading bore 6. FIG. 11 shows the state before the temporary crimping processing takes place.

Figure 12:
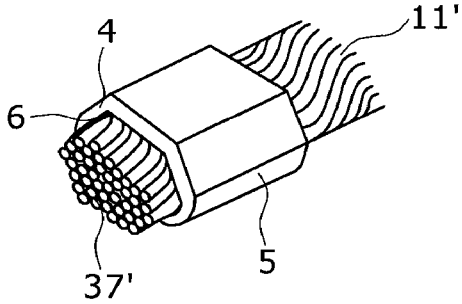
FIG. 12 is a perspective view showing the state of the twisted wire inserted in the crimping connector as per FIG. 11 after the temporary crimping process applied.
Figure 13:
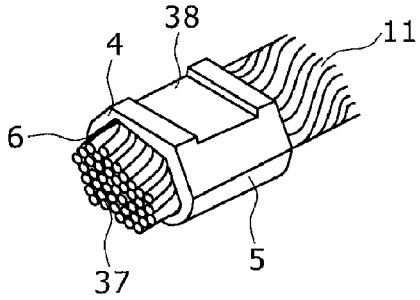
FIG. 13 is a perspective view showing the state of the twisted wire inserted in the crimping connector as per FIG. 12 after the fusing process applied.

FIG. 12 is a perspective view showing the state of the twisted wire inserted in the crimping connector as per FIG. 11 but after having gone through the temporary crimping process. FIG. 13 is a perspective view showing the state of the twisted wire inserted in the crimping connector as per FIG. 12 but after having gone through the fusing process. The conductor wire connecting part 5 has the trace of electrode 38 left through the fusing process.

The above-mentioned embodiment has showed a joining terminal, the cross-sectional shape of which is symmetric. Both end parts in the cross-section need not have the same shape, and only one of the both end parts may be thinned as shown in FIG. 6. Only one end part in the cross-section of a joining terminal maybe formed concave toward the center of the cross-section as shown in FIG. 10. In this case, one twisted wire may be arranged in the end part in the cross-section which has been thinned as shown in FIG. 6 or formed concave toward the center of the cross-section as shown in FIG. 10

The shape of head of the side-pushing jigs 32 and 33 are not limited to what are shown in FIG. 10, but it may have a flat plane head or a head of other more complex shape. The use of the side-pushing jigs 32 and 33 also makes it possible to suppress expansion of cross-sectional area of the end part in the cross-section of the joining terminal. That is, cross-sectional area can be held smaller. To put it another way, dimensional increase in longer direction in any particular cross-section can be suppressed. In such a case, the end part of a cross-section of a joining terminal will retain the trace indicating that suppressive trial was made on the dimensional increase in longer direction of a particular cross-section.

The above-mentioned embodiments are described on the assumption of using the tube-shaped crimping connector. However, the present invention is not limited to the use of the tube-shaped crimping connector, and it is no matter if the crimping connector made of sheet rolled into a shape of tube (like a ring) may be used. In this case, either will do if the crimping connector made of sheet may be rolled into a shape of tube after plural enamel-coated conductor wires is first placed on the sheet, or if the crimping connector made of sheet may be rolled into a shape of tube in the first place just like the case of the tube-shaped crimping connector and after that plural enamel-coated conductor wires is set in the connector. Furthermore, it is also within permissibility that in the course of rolling sheet into the crimping connector made of sheet, the connector is held in a state of some slit remaining on the side of the tube (namely, in a state in which the connector has a C-letter shape cross-section) allowing plural enamel-coated conductor wires to be filled in through the above slit.

The electric motor manufacturing industry has the manufacturing processes where the lead wires of the stators of polyphase rotary electric machines need to be connected to the connecting components by crimping as well as by heating. The present invention is useful and effective for such connection works in the above manufacturing processes.

What is claimed is:

1. An electric conductor wire connecting method comprising the steps of:

inserting a plurality of enamel-coated conductor wires into a tube-shaped crimping connector;

heating and crimping the enamel-coated conductor wires by pinching and pressing, with a pair of electrodes having flat pressing faces, and electrifying the crimping connector;

pressing and deforming the crimping connector and the enamel-coated wires simultaneously; and discharging melted enamel coating from the crimping connector, wherein the method includes:

a fusing process wherein the conductor wires are electrically connected together in the crimping connector; and a temporary crimping process wherein, prior to the fusing process, a plurality of the enamel-coated conductor wires are inserted in the crimping connector and, by mechanical pressurizing means, temporary crimping is applied to the crimping connector, wherein, with respect to the cross-section of the crimping connector orthogonal to the axis of the crimping connector, temporary crimping applied to the crimping connector is utilized to suppress possible expansion in area due to external force given to both the end parts or either one of them in the cross-section, while trying also to keep an area of both the end parts or either of them of the cross section as small as possible, wherein the crimping connector is formed to have flat portions by the mechanical pressuring means during the temporary crimping process, wherein the flat portions of the crimping connector are pressed by the pair of electrodes having flat pressing faces during the fusing process, and wherein the pair of electrodes having flat pressing faces is different from the mechanical pressuring means.

2. The conductor wire connecting method according to claim 1, wherein the temporary crimping process of the crimping connector is performed such that either one or both end parts of the cross-section of the crimping connector are made to become slimmer toward outside or dented toward inside, while a remaining portion is made flat.

3. The conductor wire connecting method according to claim 1, wherein the crimping connector,. which has a tubular shape originally, is pressed and deformed into a hexagonal shape through the temporary crimping process carried out by a pair of molds, each mold with its pressing face having a cross-section of a trapezoidal concave, and, subsequently in the fusing process, pressure is further applied to the hexagonal shape by the pair of electrodes having flat pressing faces.

4. The conductor wire connecting method according to claim 1, wherein lead wires for a neutral point of windings of respective phases in a polyphase rotary electric machine are connected with the enamel-coated conductor wires during the temporary crimping process and the fusing process, and are arranged in both the end parts of the cross-section of the crimping connector.

* * * * *